United States Patent [19]

Hennessey

[11] Patent Number: 4,688,636

[45] Date of Patent: Aug. 25, 1987

[54] NON-WELD CASING CENTRALIZER

[76] Inventor: Albert Hennessey, 7720-17 Street, Edmonton, Alberta, Canada, T6P 1S7

[21] Appl. No.: 850,617

[22] Filed: Apr. 11, 1986

[51] Int. Cl.[4] ..... E21B 17/10

[52] U.S. Cl. ..... 166/241

[58] Field of Search ..... 166/241, 172, 166; 175/325

[56] References Cited

U.S. PATENT DOCUMENTS

| | | | |
|---|---|---|---|
| 4,042,022 | 8/1977 | Wills et al. | 166/241 |
| 4,077,470 | 3/1978 | Dane | 166/241 X |
| 4,363,360 | 12/1982 | Richey | 166/241 |
| 4,520,869 | 6/1985 | Svenson | 166/241 |

FOREIGN PATENT DOCUMENTS

| | | | |
|---|---|---|---|
| 0636369 | 12/1978 | U.S.S.R. | 166/241 |

*Primary Examiner*—Stephen J. Novosad
*Assistant Examiner*—Thuy M. Bui
*Attorney, Agent, or Firm*—Kenneth E. Darnell

[57] ABSTRACT

A centering device or centralizer for mounting on oil well tubings and similar conduit strings, the invention acts to maintain substantially uniform clearance between such strings and a wellbore. The centering device of the invention differs from prior non-welded centering devices in that the present device does not require bending or deformation of any of its structural elements during assembly or disassembly yet displays the necessary stand-off characteristics during utilization of the device within the wellbore to assure uniform clearance between the wellbore and the casing. A particular feature of the invention is an independent retaining ring which securely attaches a plurality of structural elements to form the present centering device.

17 Claims, 5 Drawing Figures

NON-WELD CASING CENTRALIZER

BACKGROUND OF THE INVENTION

1. Field of the Invention

The present invention relates to centering devices which are mounted on oil well casings, tubings and similar conduit strings for maintaining substantially uniform clearance between such strings and the wellbore.

2. Description of the Prior Art

Centering devices for oil well casings, also known as centralizers, have conventionally consisted of outwardly bowed springs being annularly arranged and attached to axially-spaced collars for placement about an oil well conduit string. A common practice in this field is the welding of a plurality of outwardly bowed springs to collars at the ends of the device. Alternatively, prior devices have been manufactured of uniquely formed collars and springs which can then be assembled without the need for welding. It has been recognized in the prior art that welding adversely affects the physical properties of the springs and also requires substantial investment in specialized fixtures, jigs and welding equipment to complete the manufacture of these prior centering devices. It has also been found that this method of manufacture and assembly results in a centering device which is costly to transport and store due to the low weight per volume ratio inherent to the welded type centering device. Accordingly, it has been recognized that the welding of centralizers should be avoided as described in Canadian Pat. Nos. 800,828, and 712,423. These patents describe a centralizer device which can be shipped within confined spaces and allow for assembly at the point of use. However, the centralizer device described in Canadian Pat. No. 712,423 utilizes a spot welding process in the assembly of the inner sleeve and outer collar section and furthermore requires the use of substantial effort and proper tools for disassembly. Furthermore, the centralizer of Canadian Pat. No. 712,423 has the inherent feature that bending and torsional stresses are applied by a portion of the outwardly bowed springs after the centralizer has been assembled. Canadian Pat. No. 800,828 describes a centralizer which, unlike the centralizer described in Canadian Pat. 712,423, requires that a portion of the centralizer collar, described as the tongue therein, is to be bent in order to assemble the spring to the centralizer collar. The required force to bend the tongue during the assembly procedure is considerable and as a result of this force generally being applied to the tongue by the use of a hammer or other such object being used by a person, this applied force is generally inconsistent and uncontrollable, thus resulting in possible damage of the centralizer collar. With such a centralizer collar being damaged, installation of the assembled centralizer to the conduit string can be hampered.

The present centralizer device improves upon prior non-welded centralizers by not requiring deformation or bending of its elements during assembly of the device. Accordingly, all technical skills and quality control required in the forming of the centralizer elements is maintained within the manufacturing facility.

SUMMARY OF THE INVENTION

The present invention provides a non-welded casing centralizer which can be mounted on an oil well casing to assure uniform clearance between the wellbore and the casing. According to a particular feature of the invention, a retainer ring is used to secure centralizer springs to a collar, the retainer ring engaging both the springs and the collar to form a positive lock therebetween. Through the utilization of separate retainer rings, the centralizer of the invention is able to resist all combinations of longitudinal and axial forces applied thereto which are incident to its use. The application of unbalanced axial forces upon the present centralizer, which results in longitudinal compression and tension forces acting on opposite sides of the centralizer, will not dislodge the bowed elements from the collars.

Accordingly, it is an object of the present invention to provide a centering device or centralizer for conduit strings that can be shipped to a point of use in a disassembled and compact condition, and then assembled readily at the point of use thus resulting in substantial savings in transportation cost and/or storage costs.

It is another object of the invention to provide a centering device or centralizer for conduit strings which requires no special tools or fixtures for assembly or disassembly.

It is yet another object of the invention to provide a centering device or centralizer for conduit strings which does not require bending or deformation of any of the components during assembly or disassembly, therefore eliminating possible damage during these operations.

It is a further object of the invention to provide a centering device or centralizer for conduit strings which requires no welding processes to be utilized during assembly or sub-assembly of any of the components, thereby resulting in further cost savings.

Yet another object of the invention is the provision of a centering device or centralizer for conduit strings which, upon assembly and under normal use and handling of the centralizer, will provide a unit that resists abrasions and stresses which are incident to the use of such a device.

It is a still further object of the invention to provide a centering device or centralizer for conduit strings which is simply assembled, is economical to manufacture, and is of strong and sturdy construction.

Other objects and advantages of the invention will become more readily apparent in light of the following detailed description of the preferred embodiments.

DESCRIPTION OF THE PREFERRED EMBODIMENTS

Figure 1:
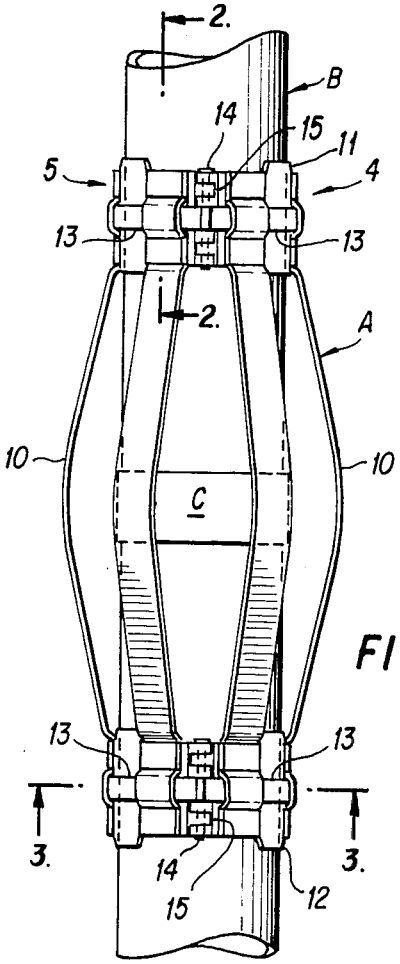
FIG. 1 is a side elevational view of the present centering device mounted on a conduit string.
Figure 2:
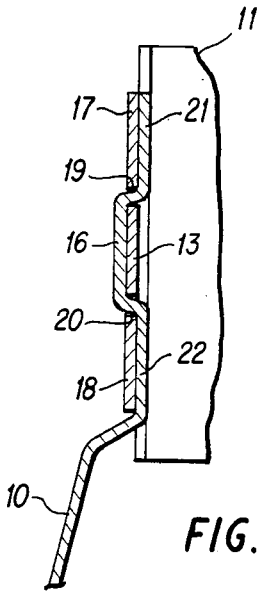
FIG. 2 is a detail section taken along line 2—2 of FIG. 1.

Referring now to the drawings and particularly to FIG. 1, a centering device A or centralizer is seen to be mounted on a conduit string B, such as a ring of a well casing. The conduit string B can have any type of stop collar C suitably secured to conduit string B between slidably mounted upper and lower collars 11, 12 of the centering device. As is known in the art, in lieu of mounting the centering device A on opposite sides of the stop collar C, the centering device could be mounted over a coupling member of other form with such a coupling member functioning as a stop collar. Symmetrically arranged outwardly bowed springs 10 are secured to the upper and lower collars 11, 12 by the use of retainer rings 13.

The centering device A, as illustrated in FIG. 1, consists of two main half sections 4,5 which can be placed laterally around the conduit string B and then secured to one another. The two half sections 4, 5 are duplicates of one another and are assembled and pinned together manually without the aid of special tools. The half sections 4, 5 are secured to one another by placing of each half section around the conduit string and then inserting hinge pins 14 through interleaved hinge knuckles 15 on diametrically opposite sides of each of the collars 11, 12.

Disposed about each of the collars 11, 12, in accordance with the number of outwardly bowed springs 10 are openings, generally designated 25, which are conveniently formed by cutting out rectangular slots during the forming operation. Each opening 25 has upper and lower shoulders, designated 19 and 20 respectively, which are axially spaced apart sufficiently to snugly but freely receive therebetween a generally U-shaped offset element 16 at the end of each of the outwardly bowed springs 10. Portions 17 and 18 of the collar above and below each opening 25 are recessed outwardly by an amount at least equal to the thickness of the outwardly bowed springs 10. The portion 17 and 18 of the collar are transversed by portions 21 and 22 of the outwardly bowed spring 10 during assembly. The generally U-shaped offset element 16 snugly but freely receives therebetween the portions 21 and 22 of the outwardly bowed spring 10.

Figure 3:
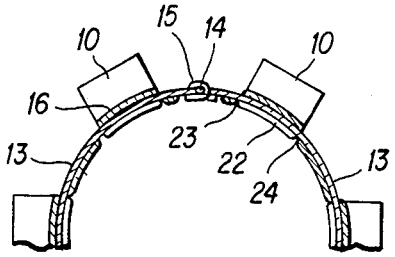
FIG. 3 is a detail section taken along line 3—3 of FIG. 1.
Figure 4:
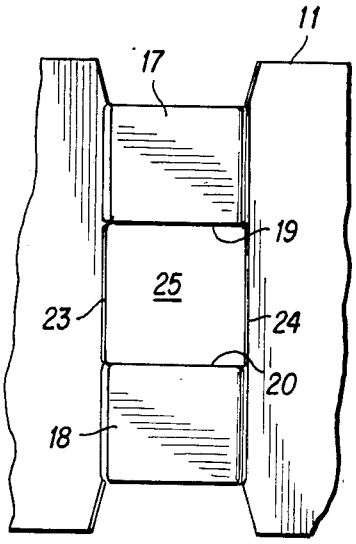
FIG. 4 is a side elevational view in detail of the collar opening.
Figure 5:
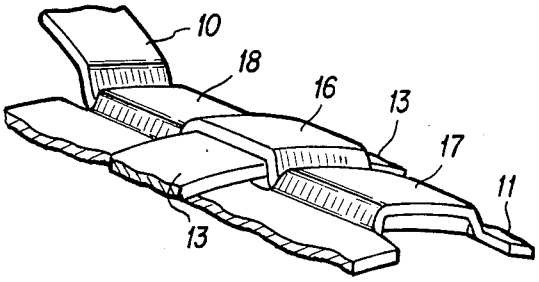
FIG. 5 is a perspective view of a portion of one of the collars assembled with a bowed element.

The generally U-shaped offset element 16 at each end of the outwardly bowed spring 10 is offset to a distance that is at least equal to the combined thickness of one of the collars 11, 12 and the retainer ring 13. The nesting of the end of the outwardly bowed spring 10 into the collar opening 25 and the portions 17 and 18 permits the insertion of the retainer ring 13 over the outside circumference of the collar and under the protruding offset element 16 of the bowed spring 10. Thus the bridging of the retainer ring 13 across the opening 25 and under the offset element 16 will firmly hold the outwardly bowed spring 10 within the opening 25 and recessed portions 17 and 18 of the collar. The axial length of the generally U-shaped offset element 16 is of sufficient length to freely but snugly allow the retainer ring 13 to pass under the offset when bridging from the edges 23 and 24 as shown in FIG. 3 of the collar opening 25 as shown in FIG. 4.

In operation, the centering device or centralizer will first be assembled from collars, retainer rings and outwardly bowed springs of the desired size and configuration. The end portion of each of the outwardly bowed springs will be placed into the collar. The generally U-shaped offset 16 of the outwardly bowed spring 10 is nested into the opening 25 with the portions 21 and 22 of the outwardly bowed spring fitting into the generally U-shaped offsets 17 and 18 of the collar. As stated, the offset U-shaped elements of the collar and the corresponding openings are formed to freely but snugly receive the ends of the outwardly bowed spring. To complete the assembly, the retainer ring 13 is positioned over the outside circumference of the collar and slid under the U-shaped offset of the outwardly bowed spring, the retainer ring being of sufficient length to engage all of the ends of the outwardly bowed springs which are installed in each collar element. The retainer ring is inserted around the circumference of the collar through the end of the outwardly bowed springs to a position which allows the insertion of the hinge pins 14 through the hinges 15. Upon assembly of the two main half sections about the conduit string, the insertion of the hinge pins prevent rotation of the retainer rings about the circumference of the collar as shown in FIG. 3. The hinge pins act, in addition to their function of holding the collar elements together by being inserted through the interleaved hinge knuckles 15, as a stop against which the ends of the retainer ring engage upon rotation about the collar element.

Thus the required collars, retainer rings and bowed elements can be withdrawn from general stock and assembled readily in a shop or in the field at the point of use. Upon assembly the centralizer unit is held firmly together without stress upon any of the elements.

In applying the centralizer to the conduit string the half sections may be disconnnected by removal of the hinge pins and can then be reassembled around the conduit string by reinserting the hinge pins. Other means of assembly about the conduit string may be utilized if desired.

During the insertion of the conduit string into the wellbore, the centralizer, being located over the stop collar C, or casing collar as so desired, will have the face of the lower collar 12 bear upon the stop collar and be drawn into the wellbore by the movement of the stop collar being attached to the conduit string. In the event it is desired to reciprocate or withdraw the conduit string from the wellbore, both operations can readily be performed. In the event that the centralizers are not used upon their assembly, removal of the hinge pins 14 and the withdrawal of the retainer rings 13 would permit the disassembly of the centralizer unit.

The invention may be modified in various respects as will occur to those skilled in the art, and the exclusive use of all modifications that come within the scope of the appended claims is contemplated.

What is claimed is:

1. A centering device adapted to be mounted on a conduit string to be disposed in a wellbore, comprising:

upper and lower longitudinally spaced collars, the collars each comprising two half sections adapted to be secured together with pins, each section having a plurality of circumferentially spaced openings therein with axially opposed radial recesses on each side of the opening forming opposing shoulders;

connecting bowed elements having a generally U-shaped offset in the end portions thereof, said offset nesting in the opening of the collar; and, a retainer ring which projects circumferentially around the outer periphery of the collar across the openings within the confines of the offset to secure the element in the recess.

2. The centering device of claim 1 wherein each bowed element is formed from spring strap material.

3. The centering device of claim 1 wherein the offset is snugly received and secured in said opening without bending or torsional stress.

4. The centering device of claim 1 wherein the offset is freely but snugly received between said opposing shoulders for resisting relative axial displacement of said collar and said bowed element.

5. The centering device of claim 1 wherein the radial recesses in the collars are recessed an amount at least substantially equal to the thickness of the bowed element adjacent said offset for accommodating said element within the general circumferential confines of said collar.

6. The centering device of claim 1 wherein the offset in the end portions of each of the bowed elements is offset an amount at least substantially equal to the combined thickness of said retainer ring and said bowed element for accommodating said retainer ring within the confines of the offset and outside of the circumferential body of said collar.

7. The centering device of claim 1 wherein each retainer ring is freely but snugly received within the axial length of each U-shaped offset of each of the bowed elements for detachably securing together said collar and said bowed elements.

8. The centering device of claim 1 wherein the retainer ring is of a length which projects circumferentially along the periphery of the collar with said ring being secured from rotation about the collar by the pins.

9. The centering device of claim 1 wherein the end portion of each of the bowed elements is formed having a radial contour conforming to the radial recesses of the collar.

10. The centering device of claim 1 wherein each half section carries a retainer ring, the retainer rings being of a length in radians which is equal to the length in radians of the half section minus the diameter of one of the pins, the retainer ring being secured from rotation about the collar by said pins.

11. A centralizer adapted to be mounted on a conduit string, comprising:

upper and lower longitudinally spaced collars, each collar comprising at least two arcuate sections capable of being connected together about said conduit string;

hinge means for connecting the sections together to form each one of said collars, each section having at least one opening formed circumferentially therein, the portions of the sections above and below each opening being recessed outwardly from major external surfaces of the sections and defining shoulders on upper and lower edges of the opening, the portions further defining channels which communicate with the opening at the shoulders, each channel extending outwardly of the section at least at that edge of each collar facing the other collar;

a plurality of elongated spring-like elements having bowed portions intermediate the ends thereof, each spring-like element having a U-shaped offset element near each end of said spring-like elements, each U-shaped offset element defining a channel which opens in surmounting relation to major external surfaces of the section at lateral edges of each opening, each spring-like element further having distal and proximal portions on each side of each U-shaped offset element, the distal and proximal portions at each end of said spring-like elements substantially lying in a plane, the U-shaped offset elements on the ends of a given spring-like element being each received in one of the openings formed in the sections of the spaced collars with outer portions of the offset elements extending outwardly of the collars, the given spring-like element thereby extending between the spaced collars, the distal and proximal portions at each end of the spring-like elements being received within the channels defined by the outwardly recessed portions of the sections, the shoulders of each of the openings being proximate to side portions of the U-shaped offset element received within said opening;

an arcuate retainer ring carried on the outer face of each of the sections, each ring being received within the channels defined by the U-shaped offset elements carried by said section and extending over and in contact with the major external surfaces of the section lying laterally of the opening or openings formed in said section, the retainer rings fixing the spring-like elements to the collars without the necessity for bending any portion of the centralizer during assembly; and means carried by each collar for limiting circumferential displacement of the retainer rings.

12. The centralizer of claim 11 wherein the limiting means comprise pins which cooperate with the hinge means to hold the sections together.

13. The centralizer of claim 12 wherein each retainer ring is of a length in radians which is equal to the length in radians of the section minus the diameter of one of the pins.

14. The centralizer of claim 11 wherein the U-shaped offset elements are each offset from adjacent end portions a distance which causes the channel defined by said offset to have a height which is substantially equal to or slightly greater than the thickness of the retainer ring.

15. In a centalizer adapted to be mounted on a conduit string and including spaced collars, bowed springs having U-shaped offset elements at the ends thereof, and openings formed in the collars to receive the U-shaped offset elements, the improvement comprising:

an arcuate retainer ring carried on the outer face of each of the collars and being received within the U-shaped portions of the offset elements extending from said openings, the retainer rings fixing the spring-like elements to the collars without the necessity for bending or deforming any portion of the centralizer during assembly.

16. In the centralizer of claim 15 wherein the U-shaped offset elements are offset from adjacent portions of the bowed springs a distance substantially equal to or slightly greater than the thickness of the retainer ring.

17. In the centralizer of claim 15 and further comprising means carried by each collar for limiting circumferential displacement of the retainer rings.

* * * * *